US007066731B2

(12) United States Patent
Tenaglia et al.

(10) Patent No.: US 7,066,731 B2
(45) Date of Patent: Jun. 27, 2006

(54) METHOD FOR CONDITIONING/HEAT TREATMENT

(75) Inventors: Davide F. Tenaglia, Broomfield, CO (US); Ken-Ichi Shimazu, Briarcliff Manor, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/839,637

(22) Filed: May 5, 2004

(65) Prior Publication Data

US 2005/0250066 A1 Nov. 10, 2005

(51) Int. Cl.
*F27D 5/00* (2006.01)

(52) U.S. Cl. ..... 432/226; 432/258; 165/185

(58) Field of Classification Search ..... 432/179, 432/194, 202, 216, 226, 253, 258; 165/185; 29/505, 514

See application file for complete search history.

(56) References Cited

U.S. PATENT DOCUMENTS 2,754,606 A * 7/1956 Williams ..... 101/489
5,245,154 A * 9/1993 Sato et al. ..... 219/773
5,741,131 A * 4/1998 DeGeorge et al. ..... 432/258
5,786,129 A * 7/1998 Ellis ..... 430/302
5,794,684 A * 8/1998 Jacoby ..... 165/80.3
5,948,301 A * 9/1999 Liebermann ..... 219/395
6,859,999 B1 * 3/2005 Huber et al. ..... 29/610.1

* cited by examiner

*Primary Examiner*—Gregory Wilson
(74) *Attorney, Agent, or Firm*—Mark G. Bocchetti

(57) ABSTRACT

A method for heat treatment of printing plates includes arranging a plurality of printing plates into a stack, interspersing a plurality of thermally conductive plates at a plurality of levels in the stack, and placing the stack of plurality of printing plates with the interspersed conductive plates in an ambient of heated medium, wherein the conductive plates are larger laterally than the printing plates such that portions of the top and bottom surfaces of the conductive plates are exposed to the ambient of heated medium and thereby collect and conduct heat into the interior regions of the stack where the conductive plates are in thermal contact with, heating the interior regions up at a higher rate than would be achieved without the conductive plates in place.

11 Claims, 9 Drawing Sheets

METHOD FOR CONDITIONING/HEAT TREATMENT

FIELD OF THE INVENTION

The invention relates generally to heat treatment and more particularly to a method and apparatus for more rapid uniform heating and cooling of a volume of a material, such as a stack of printing plates.

BACKGROUND OF THE INVENTION

Heat treatment or conditioning is used in many manufacturing processes. In manufacturing certain types of printing plates, for example, it is desirable to subject the printing plates at certain stage or stages of production to elevated temperatures for a sustained period. As an example, as disclosed in the U.S. Pat. No. 6,461,795 (to McCullough et al.; the "'795 patent"), positive-working, heat sensitive, lithographic printing plates have been made by coating lithographic substrates with a phenolic resin composition and, shortly thereafter, heating the plates at 40–90° C. for at least four hours. The heat treatment has been found to improve the exposure processes later. In particular, the heat treatment reduces the variability of photosensitivity of the coated compositions over time.

One practical method for heat treatment that is carried out over long periods of time on multiple printing plates includes arranging the printing plates into a stack and placing the stack in a heating zone of such apparatus as an oven. For example, the '795 patent discloses wrapping multiple printing plates interleaved with paper in a packet for heat treatment. As another example, U.S. Pat. No. 6,596,457 (to Hidaka et al.; the "'457 patent") discloses stacking hundreds of printing plates for heat treatment. To assure productivity, it is desirable to stack a large number of printing plates for heat treatment at one time. However, due to limited thermal conductivity, especially when printing plates are interleaved with a material, such as paper, that is more insulating than the printing plates themselves, the temperatures near the middle of the stack rise more slowly than near either top of bottom end of the stack. This difference in heating characteristics between different regions has at least two detrimental effects. First, the interior of the stack experiences a longer heating up and cooling down periods than the surface regions of the stack. Thus, to ensure adequate heat treatment of all plates, longer heat treatment cycles must be used. Second, the interior of the stack is heated at the set temperature for a shorter period of time, if at all, than the surface regions during a heat treatment cycle. Thus, the interior of the stack has in essence a different heat treatment cycle than the surface regions of the stack. This difference may result in inconsistencies in printing plate quality or longer heat treatment time needed to ensure adequate heat treatment of the printing plates in the interior of the stack. While removing the interleaved sheets of paper may reduce this difference in heat treatment, it is often impractical because of the need for protective sheets for the printing plates.

The invention disclosed herein is aimed at providing a method and apparatus for more rapid and uniform heating and cooling throughout a stack of printing plates, substantially without many of the drawbacks of the conventional approaches.

SUMMARY OF THE INVENTION

Generally, the invention provides a method for heat treatment of a plurality of stacked objects in a way that transfers heat into the interior of the stack at an increased rate as compared to known methods. In particular, a heat exchanger, which in an illustrative embodiment of the invention includes a thermally conductive plate, is put in thermal contact with the interior region of the stack and exposed to a heat source, which can be the environment in which the stack is subjected to. The heat exchanger is configured and placed to heat up the interior region at a higher rate than if the exchanger were absent. For example, a thermally conductive plate with a sufficiently large portion of the surface exposed to a heat source is positioned to be in thermal contact with an interior region of a stack of objects such as printing plates. The exposed surface of the conductive plate collects heat and transfers the heat to the interior regions of the stack, thereby heating the interior regions up at a higher rate than without the conductive plate.

In one aspect of the invention, a method of heat treatment comprises arranging a plurality of objects into a stack comprising layers of the objects, placing a first portion of a heat exchanger in thermal contact with an interior portion of interior of the stack, heating the plurality of objects, and exposing a second portion of the heat exchanger to a heat source, thereby causing a net heat transfer from the second portion of the heat exchanger to the interior region of the stack.

According to another aspect of the invention, in a more specific example, a stack of printing plates, each of which can include a substrate coated with a resin compound and covered with a protective layer such as paper, is heat treated by positioning thermally conductive plates in the stack at various height along the direction of the height of the stack. Each thermally conductive plate used as a heat exchanger extends laterally out of the stack and thus has a portion exposed to the ambient surrounding the stack. The temperatures in the interior regions of the stack are thus changed more quickly by the heat collected by, and transferred from, the exposed portions of the conductive plate than they would be without the conductive plates as the ambient temperature changes.

According to another aspect of the invention, an apparatus for heat treatment of a stack of objects includes a plurality of heat exchangers positionable in the stack, the heat exchangers being configured to have a sufficiently large portion of each heat exchanger exposed to a heat source to collect heat from the heat source and produce a net heat transfer to the interior regions of the stack. The heat exchangers can be thermally conductive plates mounted on frame members to act as support for partial stacks of the objects.

BRIEF DESCRIPTION OF THE DRAWINGS

Other objects and advantages of the invention will become apparent upon reading the following detailed description and upon reference to the drawings in which:

FIG. 1(*b*) schematically illustrates an interior region of the arrangement shown in FIG. 1(*a*).

Figure 1A:
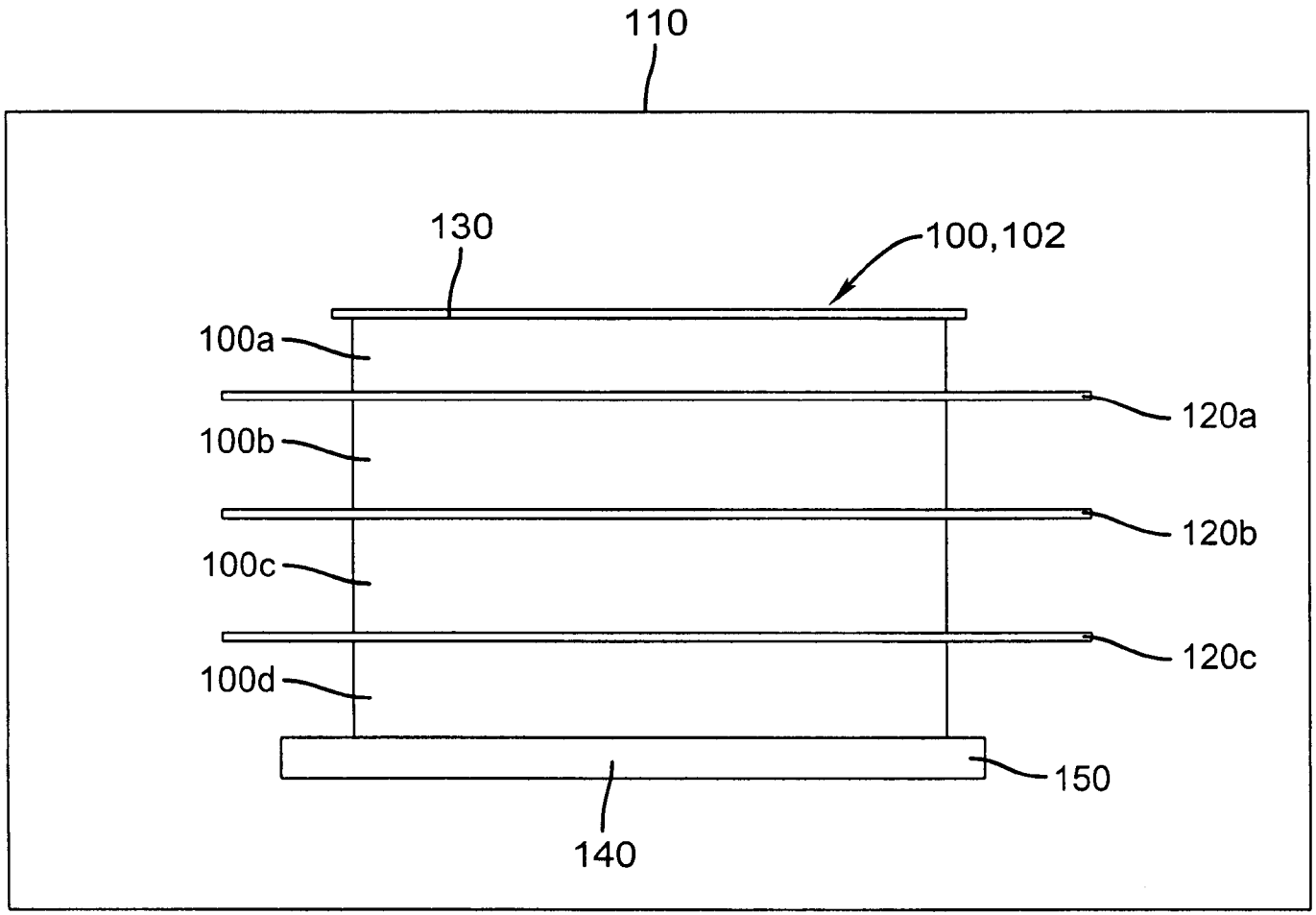
FIG. 1(*a*) schematically illustrates the arrangement of the objects being heat treated and the heat exchangers using a method according an aspect of the invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Figure 1B:
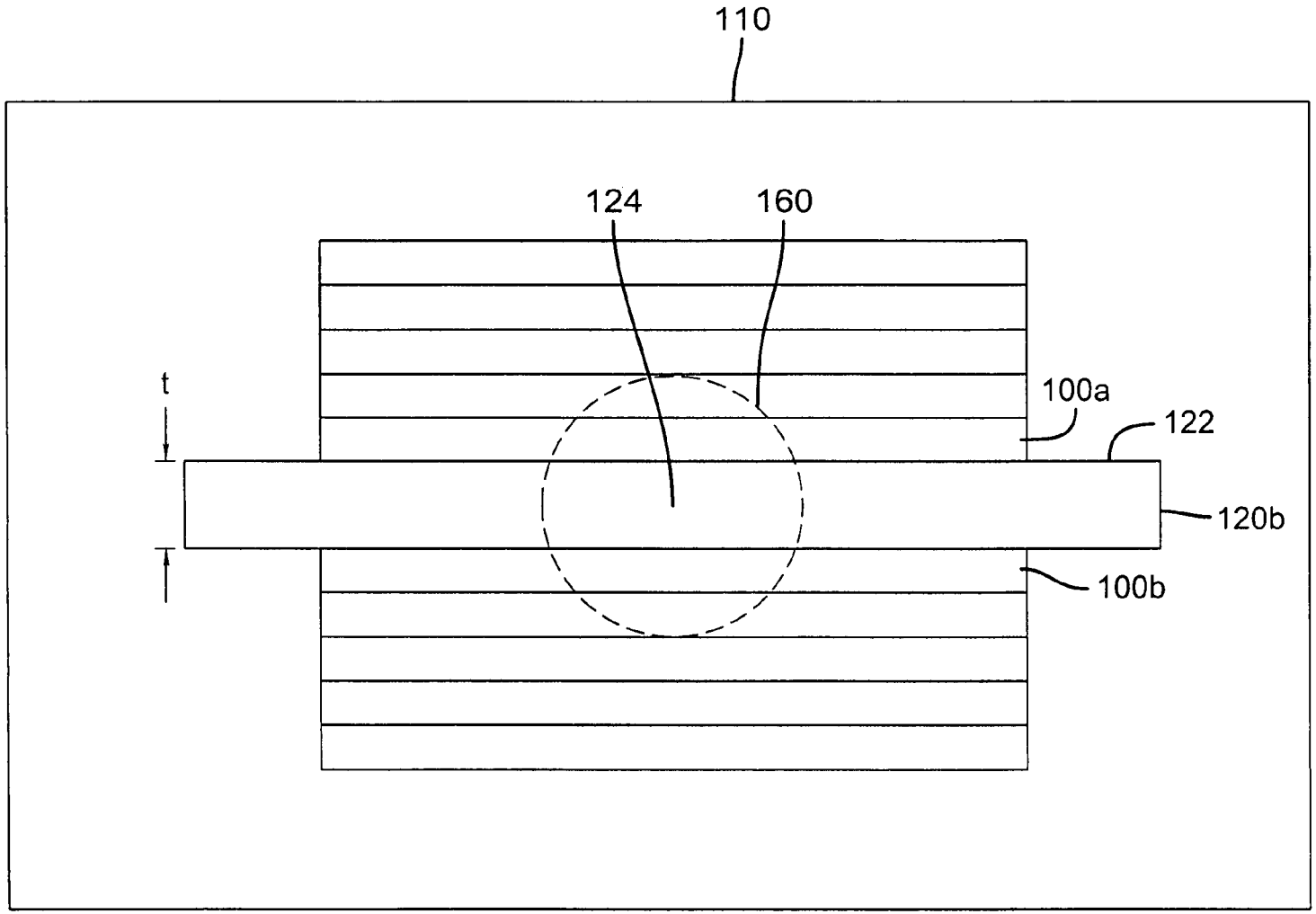
Figure 2:
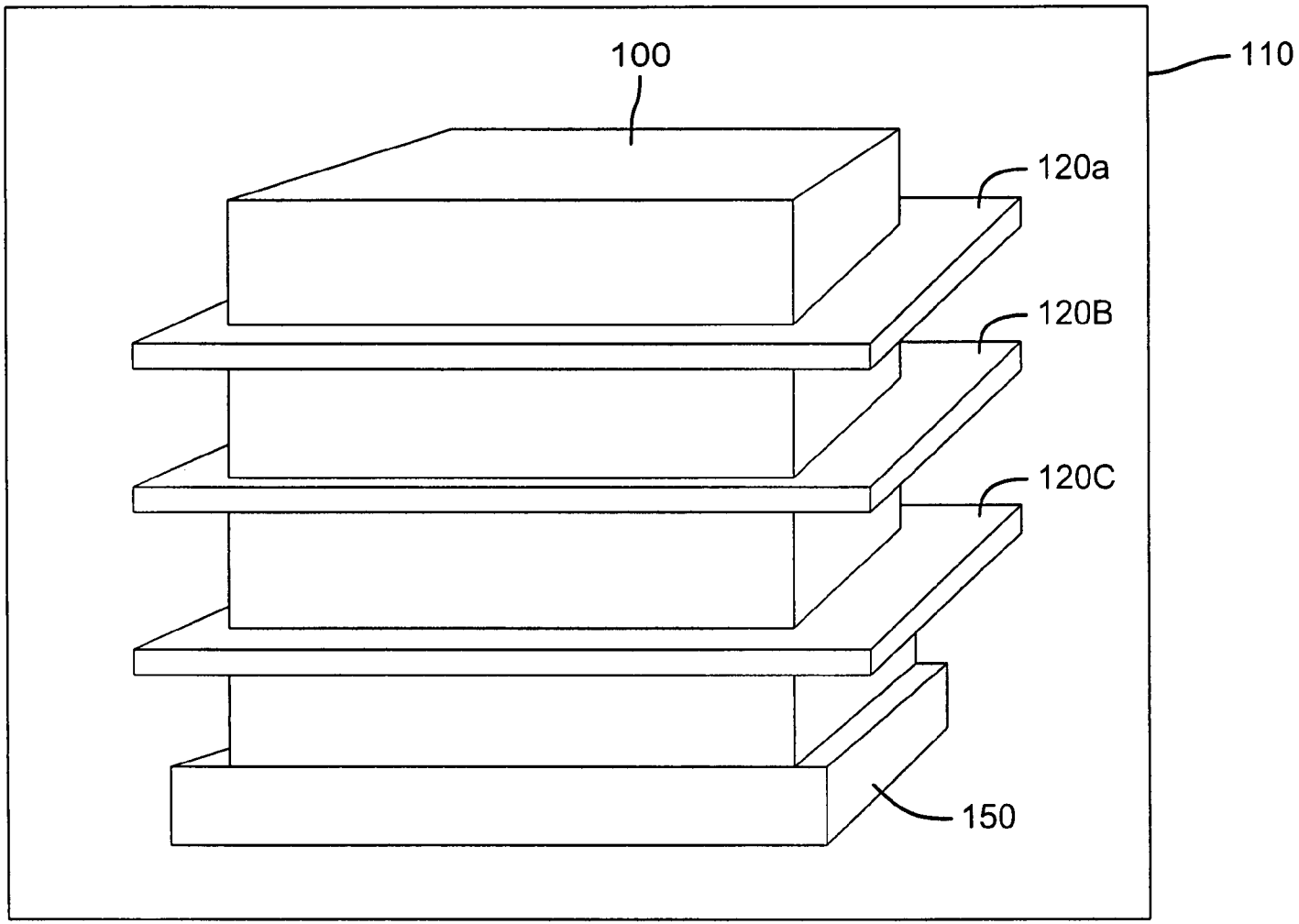
FIG. 2 schematically illustrates a perspective view of the arrangement shown in FIG. 1(*a*).

Referring to FIGS. 1 and 2, in an illustrative embodiment of the invention a plurality of printing plates 100 are arranged into a stack 102, and positioned on top of a pallet 150. Each printing plate 100 includes a substrate that is coated with a layer of resin composition, which is covered with a protective sheet of paper. For the purpose of describing the invention, the combination of a substrate, its respective resin coating and protective paper is considered a printing plate, or a single object being subjected to heat treatment. The stack 102 is positioned inside an environment of a heated medium, in this case air inside an oven 110 which is configured to set the temperature of the environment or surroundings of the stack 102 according to a desired time profile. A thermally conductive sheet 120*b* that has a larger lateral dimensions than the printing plates is placed between, and in thermal contact with, two successive plates 100*a*, 100*b* in the stack 102 at a distance from the top 130 and bottom 140 of the stack 102. An outer portion 122 of the conductive sheet 120*b* is thus exposed to a heat source, which in this case is the same heat treatment environment in which the stack 102 is placed. An inner portion 124 of the conductive sheet 120*b* is in thermal contact with an interior region 160 of the stack 102.

The conductive plate 120*b* absorbs heat from the heat source and transfers the heat to the interior regions of the stack 102. The rate of the heat transfer is determined by several factors, including surface area of the conductive plate that is exposed to the heat source, the thermal conductivity (which is determined by the choice of material used) of the plate and the geometry, including the thickness, t, of the plate. With proper combinations of these factors, heat transfer rate to the interior regions of the stack 102 can be increased by using a conductive plate as compared to the rate achieved in an otherwise identical stack but without any conductive plate inserted. For example, it is desirable that a material with high thermal conductivity, such as a metal, including aluminum and copper, be used. The larger the area 122 exposed to the heat source, generally the higher the rate of heat transfer to the interior region 160. Typically, a portion of the top and bottom surfaces of the heat exchanger is exposed to the heat source to provide sufficient heat transfer rate. Thus, for example, in a stack of printing plates being heat treated, although each individual printing plate also has its side surface exposed, the exposed surface area is typically insufficient to conduct enough heat from the ambient to heat the neighboring plates within a desired period of time. The greater the cross-sectional area, i.e., thickness of the conductive plate, generally the greater the rate of heat transfer. However, the benefit of the increased thickness of the conductive plate also diminishes when the thickness of the conductive plate become excessively large due to the increased thermal capacity of the conductive plate itself.

Thus, the conductive plate 120*b* acts as a heat exchanger, heat transfer device or means, with its exterior portion 122 acting as heat collecting "fins". With an adequately chosen conductive plate 120*b*, there is a net heat transfer from the heat exchanger to the interior region 160 of the stack 102 printing plates 100, which can therefore be heated up more quickly in a heat treatment cycle than without the conductive plate. In other words, a properly chosen conductive plate or other types of heat exchanger can be used to heat the interior regions, or the portions of plates in those regions, of a stack of printing plates during heat treatment. The conductive plate 120*b* also facilitates faster cooling of the interior region 160 at the end of heat treatment cycle, when the ambient temperature is lowered. A more uniform temperature profile throughout the stack 102 is thus more quickly achieved.

The heat exchanger in the above example has a substantially flat portion in contact with flat printing plates to achieve maximum thermal contact with the objects (plates) being heat treated. Other heat exchanger shapes can be used, particularly to maximize thermal contact with non-flat surfaces of treated objects.

It is additionally believed that the conductive plate 120*b* facilitates more uniform heat treatment of the printing plates 100 also by disrupting the flow pattern of convention surrounding the stack 102 with the exterior portion 122 of the conductive plate 120*b*.

Figure 7:
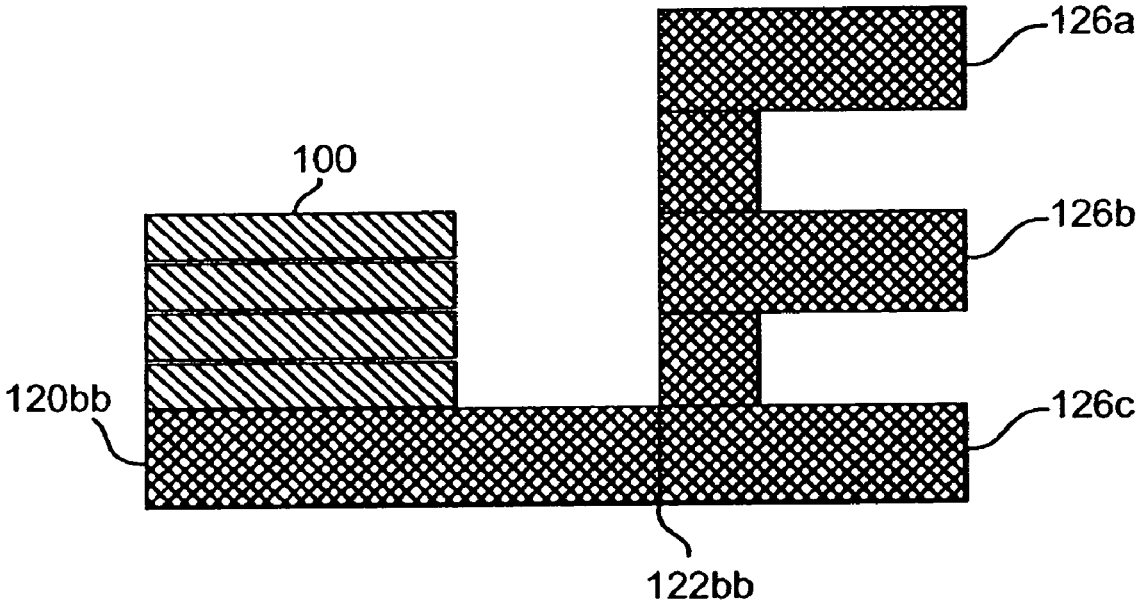
FIG. 7 schematically shows an alternative form of a heat exchanger according to another aspect of the invention.
Figure 8:
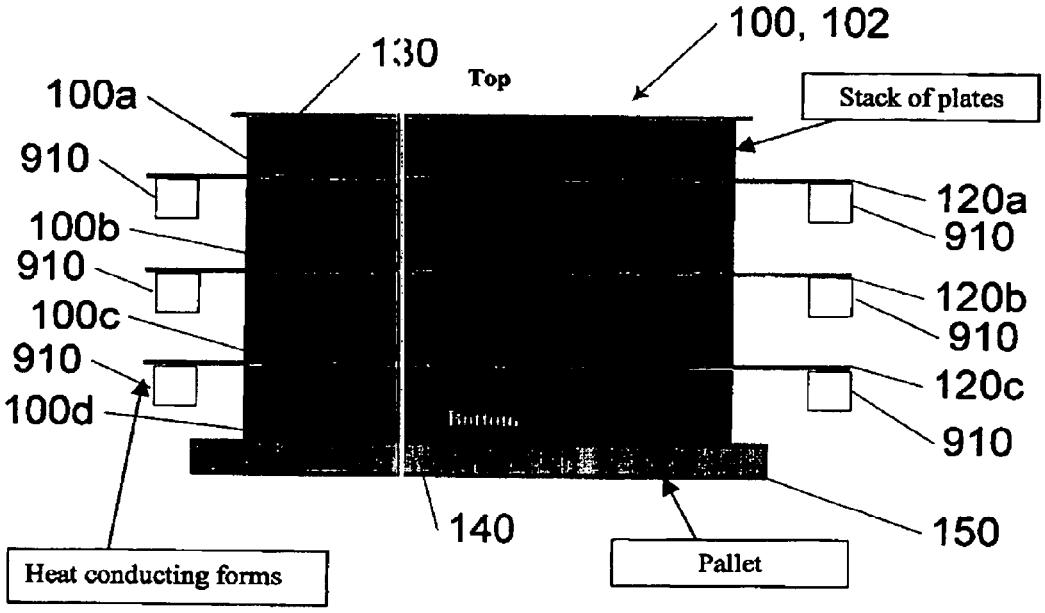
FIG. 8 schematically shows heat exchangers supported on their respective frames in an alternative embodiment of the invention.

The heat exchanger 120*b* used in the illustrative embodiment shown in FIGS. 1(*a*), 1(*b*) and 2 is a simple rectangular plate made of a conductive material such as aluminum, copper or brass. Other configurations can be used. For example, as schematically shown in FIG. 7, the exterior portions 122*bb* of the heat exchanger 120*bb* can be bent and/or include additional fins 126*a, b* and *c* to increase the heat absorption rate by the heat exchanger 120*bb*. Additional heat sources can also be applied directly to the heat exchanger. For example, the heat exchanger 120*b* can be in solid-solid contact with a portion of the oven 110 or other heat sources. Heaters such as electrical heating elements, tubings carrying heated liquid or heat exchangers utilizing phase transformation can be attached to the exterior or even interior portions of a heat exchanger.

As shown in FIGS. 1(*a*) and 2, additional heat exchangers, such as conductive plates 120*a* and 120*c* can be inserted into the stack 102 at distances from the conductive plate 120*b*. Use of multiple heat exchangers increases the uniformity of heat treatment throughout the stack 102 and further speed up the heat treatment process. Each heat exchanger can also include multiple conductive sheets to increase the cross-sectional areas of heat conduction paths in the heat exchanger.

The heat exchanger or exchangers may be isolated individual elements that can be separately placed in a stack of objects to be heat treated. Alternatively, an apparatus including supports and heat exchangers affixed to the supports can be used. The heat exchangers thus affixed act as platforms upon which partial stacks 100*a*, 100*b*, 100*c* of the stack 102 can be placed. The supports can be movable relative to each other to provide easy positioning of objects to be heat treated on the heat exchangers and assembling of the entire stack.

According to another aspect of the invention, heat treatment can also be carried out under controlled humidity. For example, the humidity can be increased relative to the typical room conditions. This can be accomplished by, for example, injecting steam or mist into the ambient (such as oven chamber) in which the stack of treated objects is disposed. Another example of humidity control includes enclosing the heat treated objects in water-impermeable wraps. Such humidity control can be important for heat treatment of certain objects such as coated printing plates, where heat treatment without humidity control can lead to excessive or uneven drying of the coating, resulting in poor or unacceptable coating quality in portions of the printing plates. Examples of apparatuses and methods for humidity control are disclosed in U.S. Pat. No. 6,706,466, which is incorporated herein by reference.

EXAMPLES

1. Baseline Data

In an alternative embodiment of the invention, as shown in FIG. 7, heat exchangers 120*a*, 120*b* and 120*c* are mounted on their respective frames 910 and can thus support the partial stacks 100*a*, 100*b* and 100*c*, respectively.

Two identical stacks of lithographic printing plates were subjected to a heat treatment cycle without using any heat exchangers. Each stack includes 500 plates. Each plate was made of aluminum and had approximate dimensions of 1.0 m×0.76 m×0.3 mm. Each plate was covered with a sheet of paper(30-pound weight, unbleached, natural Kraft paper (XKL) from Thilmany, Kaukauna, Wis.). The entire stack was set on top of a wooden pallet approximately 1.2 m×1.2 m and placed inside an oven chamber of about 5.5 m wide, 5 m high and 5 m deep (built by the Wisconsin Oven Corp., East Troy, Wis.), with temperature sensors placed at the top and bottom of the stack and mid-stack (both laterally and vertically). The oven is designed to heat its content by hot air, which enters the oven chamber from the left hand side (viewed from the front of the oven), is propelled through the oven chamber by a fan, and exits the oven chamber on the right hand side. The oven temperature was then set to 57° C., and the oven temperature reaches the set temperature generally in 10 to 15 minutes. The relative humidity in the oven chamber was set at about 25% at 57° C. using the following procedure: After the oven reached the set temperature, the temperatures of the stacks of printing plates were monitored by a remote sensor. When the temperature at the coolest-sensor, which is typically at the bottom of the stack, on the right hand side of the oven (viewed from the front of the oven), reached about 35° C. (typically after about 1–2 hours after the oven power was turned on), steam was injected into the oven chamber.

Figure 3:
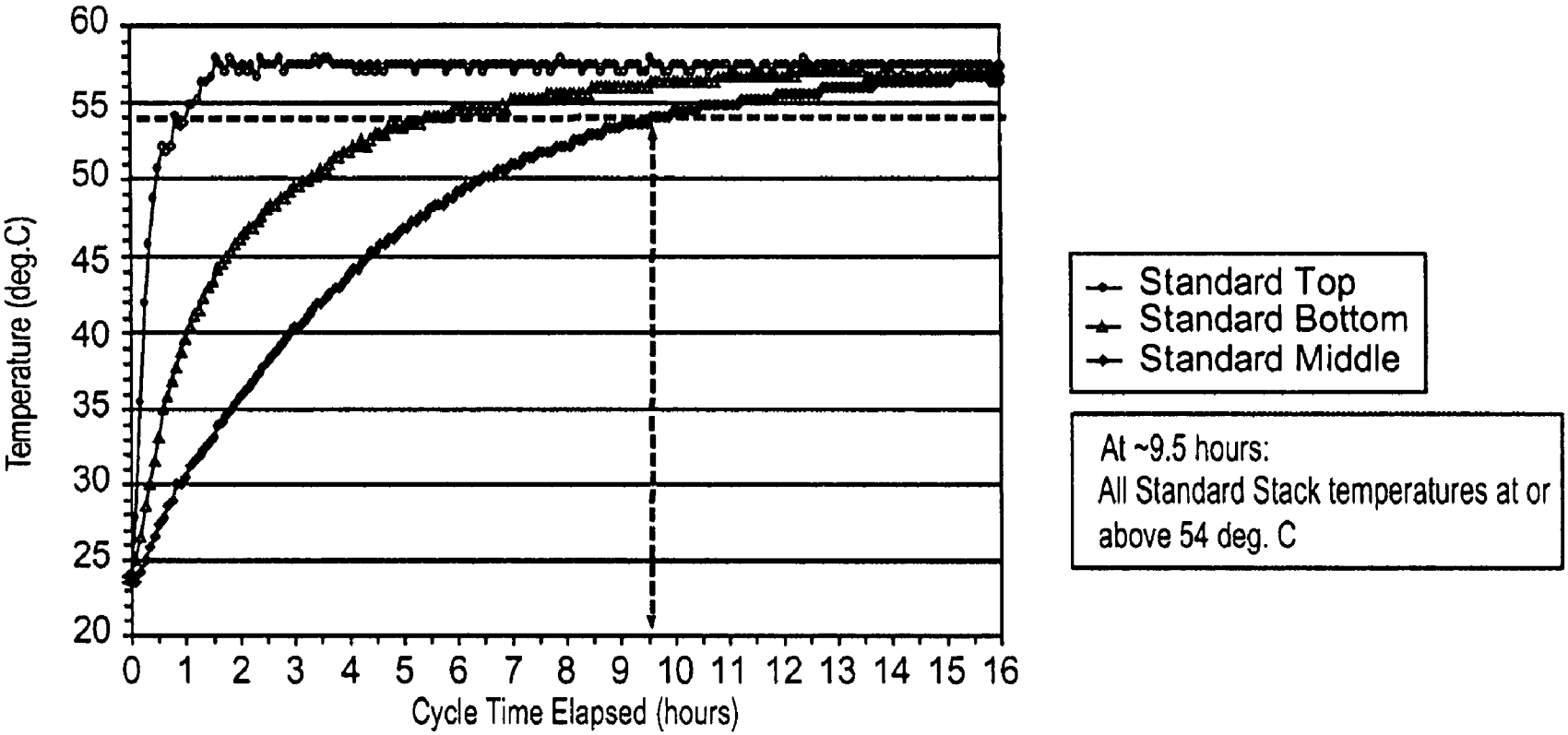
FIG. 3 shows an example of the temperatures taken over time from the top and bottom surfaces and the interior region of a stack of printing plates without the use of heat exchangers.

The signals from the temperature sensors were recorded. The results are shown in FIG. 3, which shows the temperatures and the various locations over time. As can be seen, the temperature at the top of the stack reached 54° C., or 95% of the set temperature, in about 1.5 hours while the temperature at the bottom of the stack reached the same temperature in about 5.5 hours. The temperature at the mid-stack reached 54° C. in about 9.5 hours.

2. First Example

With Three Conductive Plates

The same printing plates as used in collecting the baseline data above underwent the same heat treatment (including humidity control) as above except that three conductive plates were inserted in the stack. The top conductive plate 120*a* was located approximately 8% of the stack height down from the top of the stack; the middle conductive plate 120*b* approximately 33%; and the bottom conductive plate 120*c* about 58%. Each conductive plate was made of a stack of 35 aluminum sheets of 0.3 mm thick each and had approximate combined dimensions of 1.3 m×0.91 m×7.5 mm. Each conductive plate was generally centered laterally with respect to the stack. Additional temperature sensors were placed approximately at the lateral midpoint on top of their respective conductive plates.

Figure 4:
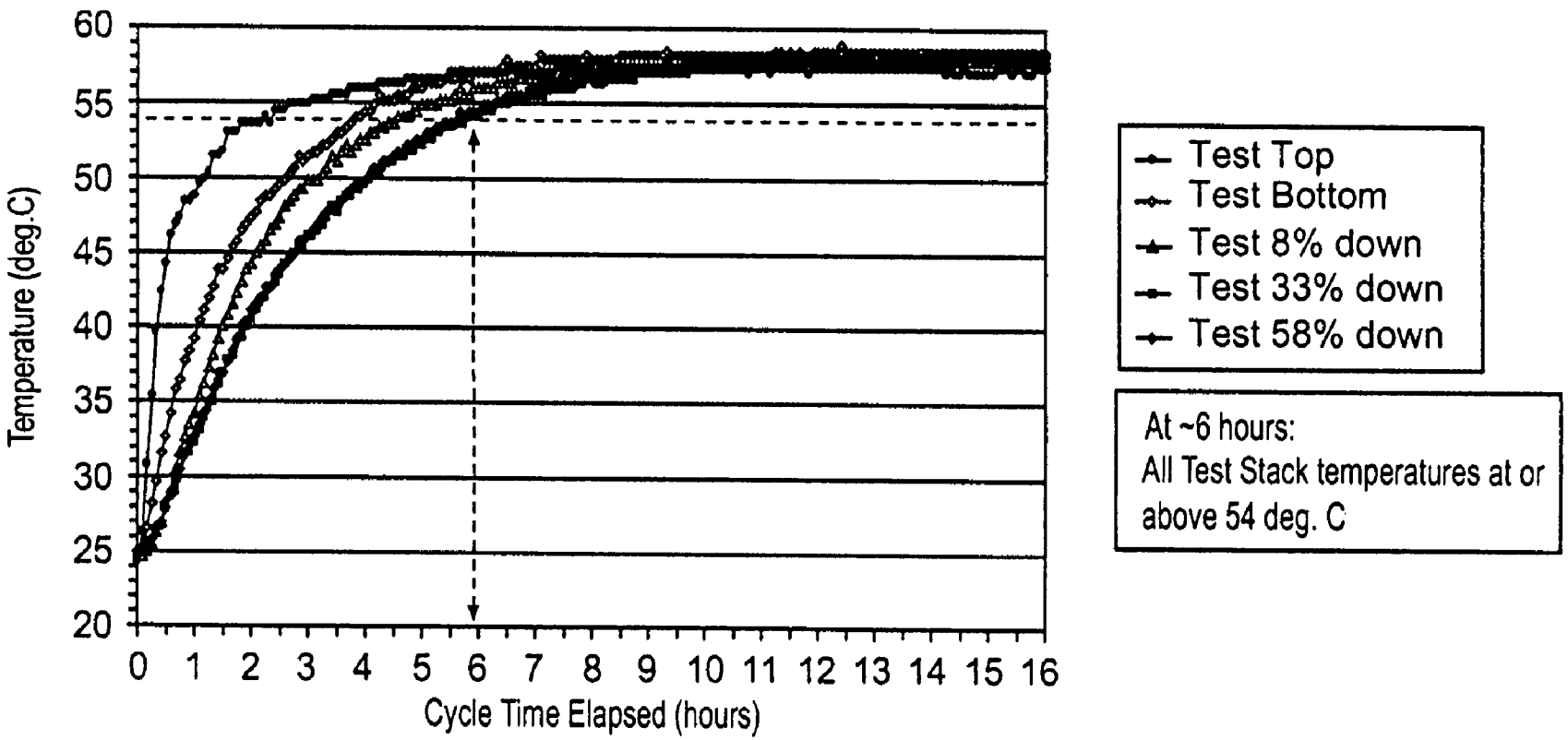
FIG. 4 shows an example of the temperatures taken over time from various locations in a stack of printing plates with heat exchangers inserted according to an aspect of the invention.

As shown in FIG. 4, the temperatures at all temperature sensors reached 54° C. in about six hours or sooner. In particular, the temperature at 58% stack height down reached 54° C. in about six hours. The temperature at mid-stack, which is close to the 58% point, is expected to be approximately the same as the temperature at the 58% point. Thus, the mid-stack temperature reached 95% of the set temperature approximately 3.5 hours more quickly with the addition of the conductive plates.

3. Second Example

With Three Conductive Plates and Higher Oven Occupancy

Figure 5:
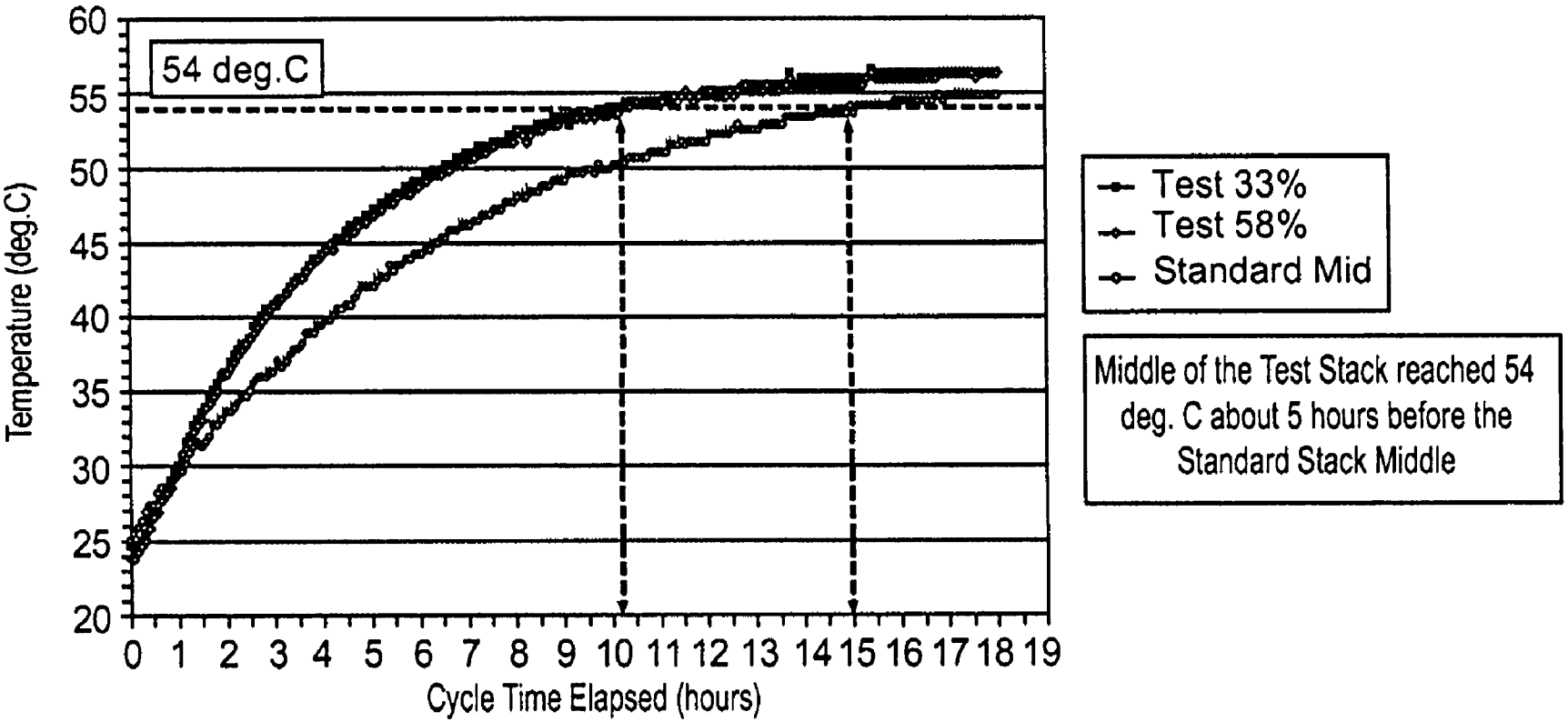
FIG. 5 shows a comparison between the temperature evolution curves for a stack of printing plates with and without heat exchangers inserted.

The same heat treatment cycles described in the two examples above were repeated, except that six stacks instead of two stacks were placed in the oven at a time to fill about half the oven's capacity. As FIG. 5 shows, the mid-stack temperature for the heat treatment cycle without any heat exchangers reached the 54° C. mark in about 15 hours whereas the temperature and the 33% and 58% height point with the heat exchangers reached that mark in only about ten hours, or about five hours faster.

Figure 6:
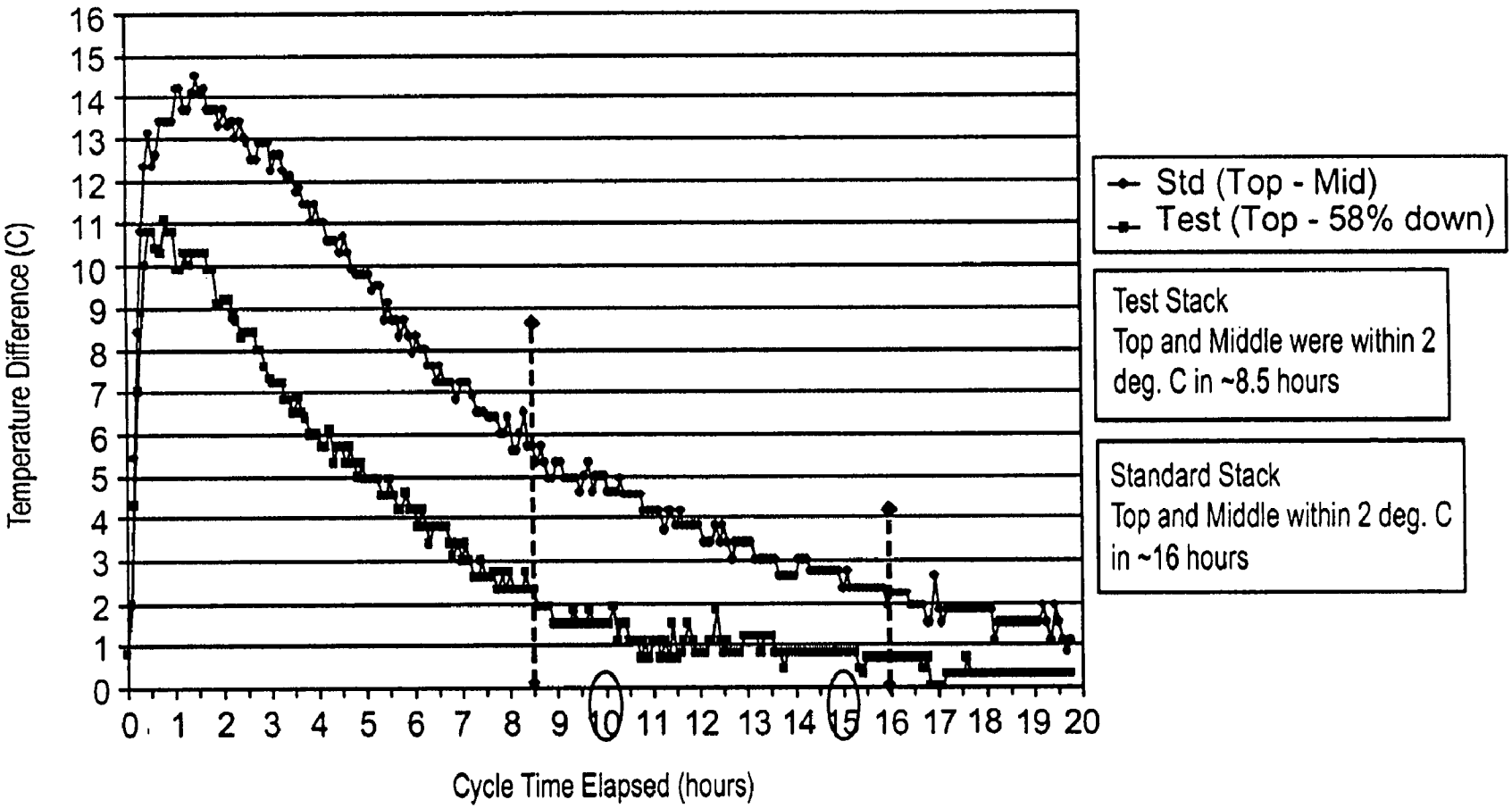
FIG. 6 shows a comparison between the temperature differences between the top surface and an interior region for a stack of printing plates with and without heat exchangers inserted.

It is also noted, as shown in FIG. 6, that the temperature difference between the interior regions of the stacks and the top of the stack decreased more rapidly in heat treatment cycles with the use of heat exchangers as well. Here, the temperature difference between the top of the stack and mid-stack dropped to below 2° C. in about 16 hours without using heat exchangers; the same drop in temperature difference took only about 8.5 hours with the use of three heat exchangers.

The heat exchangers not only increase the rate of heat transfer into the interior regions of a stack when the stack is being heated, but also increase the rate of heat transfer out of the stack as the stack is being cooled.

Thus, placing heat exchangers in a stack of plates shortens the heat treatment time needed. The use of heat exchangers also results in a more uniform temperature throughout the stack, thereby enhancing the quality of heat treatment.

The particular embodiments disclosed and portion thereof above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method of heat treating printing plates comprising:

(a) arranging a plurality of printing plates and at least one thermally conductive plate into an interleaved stack, the at least one thermally conductive plate abutting one of the plurality of printing plates on each side thereof, wherein each of the printing plates has a first perimeter and the at least one thermally conductive plate has a second perimeter, the second perimeter extending beyond the first perimeter in the interleaved stack such that the at least one thermally conductive plate yields a fin projecting from the interleaved stack; and (b) placing the interleaved stack into a heated environment such that heat from the heated environment is transferred to the fin.

2. A method as recited in claim 1 wherein:

the heated environment is an oven.

3. A method as recited in claim 1 wherein:

controlling the humidity of the heated environment.

4. A method as recited in claim 1 wherein:

the at least one thermally conductive plate forms at least one generally perimetric fin projecting from the interleaved stack.

5. A method as recited in claim 4 further comprising:

transferring heat from the heated environment to the at least one generally perimetric fin of the at least one thermally conductive plate.

6. A method as recited in claim 5 further comprising:

transferring heat from the at least one generally perimetric fin to a portion of the at least one thermally conductive plate that is in physical contact with at least one of the printing plates.

7. A method as recited in claim 5 further comprising:

transferring heat from the portion of the at least one thermally conductive plate to the printing plates of the interleaved stack.

8. A method as recited in claim 5 further comprising:

transferring heat from the portion of the at least one thermally conductive plate to the printing plates of the interleaved stack abutting the at least one thermally conductive plate.

9. A method as recited in claim 1 wherein:

heating is performed with a heat source external to the interleaved stack.

10. A method as recited in claim 1 wherein:

the at least one thermally conductive plate includes no internal heating elements or heated fluid conducting passages.

11. A method as recited in claim 1 wherein:

the at least one thermally conductive plate is abutted on each side thereof by one of the plurality of printing plates.

* * * * *